US005704543A

United States Patent [19]

Pöllänen

[11] Patent Number: 5,704,543

[45] Date of Patent: Jan. 6, 1998

[54] WINDOW-ENVELOPE

[76] Inventor: Kari Pöllänen, Mechelininkatu 21 B 56, FIN-00100 Helsinki, Finland

[21] Appl. No.: 586,680

[22] PCT Filed: Jul. 15, 1994

[86] PCT No.: PCT/FI94/00324

§ 371 Date: Jan. 25, 1996

§ 102(e) Date: Jan. 25, 1996

[87] PCT Pub. No.: WO95/03979

PCT Pub. Date: Feb. 9, 1995

[30] Foreign Application Priority Data

Jul. 28, 1993 [FI] Finland ..... 933378

[51] Int. Cl.[6] ..... B65D 27/06; B65D 27/04

[52] U.S. Cl. ..... 229/303; 229/71

[58] Field of Search ..... 229/71, 303, 304, 229/92.3

[56] References Cited

U.S. PATENT DOCUMENTS

| | | | |
|---|---|---|---|
| 1,025,837 | 5/1912 | Schnorr . | |
| 1,245,447 | 11/1917 | Felenchak | 229/303 |
| 1,303,063 | 5/1919 | Hoock . | |
| 1,438,122 | 12/1922 | McCoy | 229/303 |
| 1,827,507 | 10/1931 | Brockett | 229/303 |
| 1,988,909 | 1/1935 | MacKinnon | 229/70 |
| 2,350,100 | 5/1944 | Deutschmeister | 229/303 |
| 3,365,117 | 1/1968 | Powell, Jr. | 229/71 |
| 3,558,040 | 1/1971 | Krueger | 229/73 |
| 5,009,518 | 4/1991 | Faltynek | 383/106 |
| 5,052,613 | 10/1991 | Lin | 229/73 |

FOREIGN PATENT DOCUMENTS

| | | |
|---|---|---|
| 34 18 944 | 11/1985 | Germany . |
| 676 455 | 1/1991 | Switzerland . |
| 678 418 | 9/1991 | Switzerland . |

*Primary Examiner*—Stephen P. Garbe

*Attorney, Agent, or Firm*—Marshall, O'Toole, Gerstein, Murray & Borun

[57] ABSTRACT

The present invention is related to an envelope (1) provided with at least one window (2), said envelope being intended for double-use as a reply envelope, too. Said window is provided with a detachable flap (3), whereby said window of the envelope can be made larger by tearing off said flap from the envelope. Subsequently, the envelope can be reused for mailing a reply whereas the enlarged window of the envelope will now display the receiver name and address information preprinted on the reply letter, plus the prepaid reply postage markings and other possibly desirable information.

5 Claims, 2 Drawing Sheets

FIG. 1
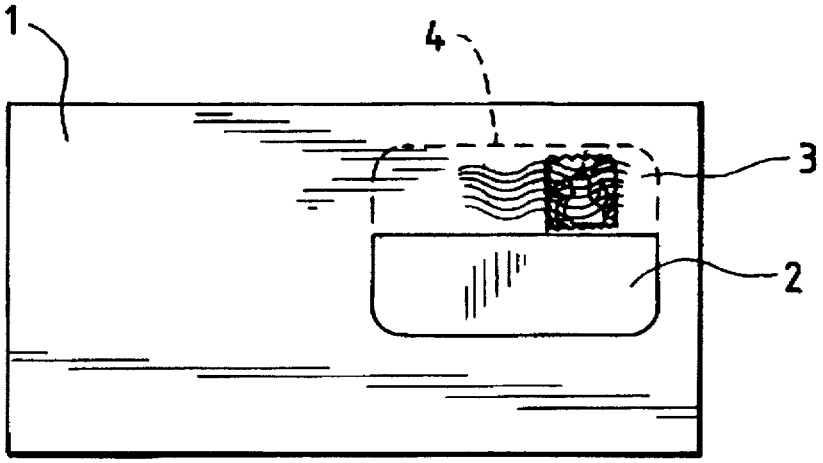
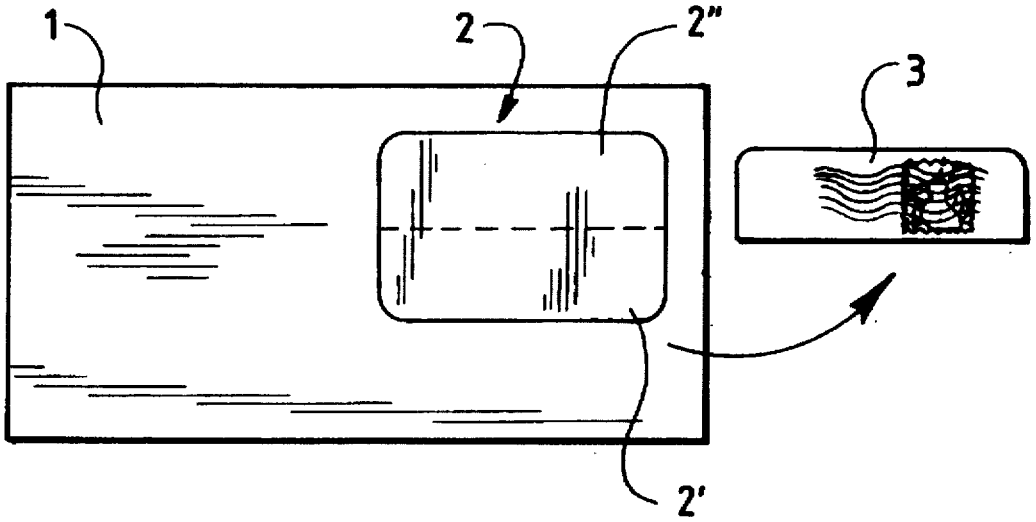
FIG. 2

WINDOW-ENVELOPE

FIELD OF THE INVENTION

The present invention relates to a letter envelope provided with at least one see-through window, said envelope being suited for use as a sender's envelope and reuse by the receiver as a reply envelope.

BACKGROUND OF THE INVENTION

Today, such activities as direct marketing frequently employ envelopes containing a reply envelope with prepaid postage. The reply envelope is ready-printed with the receiver's name and address information complemented with the contract number under which the reply receiver is committed to pay the postal authorities for the postage of the reply letters. The reply letter may also have pre-printed ruling for the writing of reply sender information. According to a more advanced embodiment, the reply sender name and address information is preprinted on the reply letter, which is thereafter folded and inserted into the reply envelope so that said information remains visible through a transparent window provided at the upper left corner of the reply envelope.

The prior-art arrangements of including a separate reply envelope are material-wasting. Given the great number of letter mailings containing a reply envelope, significant economical values are incurred by the mailings performed by direct-marketing firms and different officials.

U.S. Pat. No. 3,558,040 (Krueger) granted in Jan. 26, 1971, and the corresponding Reexamination Certificate published in Nov. 8, 1983, disclose a solution to the above-described problem of material waste based on using the original letter envelope sent by, e.g., the direct-marketing company or an official also as the reply envelope. In this embodiment the letter envelope is provided with a detachable seal part and that side of the envelope opposite to the detachable seal part has an extra flap wrapped to the inside of the envelope. When the receiver wishes to send his/her answer in such an envelope, he/she tears off the seal part, unfolds the extra flap wrapped to the inside of the envelope and then folds the flap over the original sender/receiver address information window. Said flap has the reply receiver name ready-printed on it. The flap may also have ready-printed ruling for marking the reply sender information and a notice of prepaid reply postage by the reply receiver.

In regard to material consumption, such an arrangement is more economical than the use of a separate reply envelope, whilst also in this embodiment some extra material consumption in the manufacture of the envelope is caused by the use of said extra flap in comparison to a conventional envelope. Moreover, such an embodiment is complicated and the risk of cutting a finger on the sharp edge of the envelope is present during the unfolding of the flap from the inside of the envelope.

SUMMARY OF THE INVENTION

It is an object of the present invention to achieve a significant improvement over the above-described problems by virtue of a letter envelope characterized in having at least one window which is partially covered by a detachable flap carrying any postal marking during the use of the envelope as a sender's envelope and is freed from the cover flap during the use of the envelope as the reply envelope. Material consumption in the manufacture of the envelope according to the invention is identical to that of a conventional envelope, and the receiver can convert the envelope into a reply envelope through a very simple operation of tearing off the detachable, window-enlarging flap from the envelope. As the reply letter, order form or other reply card submitted with the sent material is reinserted in the envelope, the preprinted reply receiver address information, as well as contract number of reply postage prepayment and other similar information will all fit into the enlarged window. By contrast, the standard-size window of a conventional envelope cannot show more than the reply receiver name and address information.

When a direct-marketing letter or similar message is sent to a customer, the address window is cropped to normal size thus displaying only that part of the letter containing the receiver name and address information, while the rest of the letter remains concealed. As the customer tears off the cropping flap from the envelope and inserts his/her reply letter into the same envelope, the enlarged window will display the receiver name and address information complemented will all other necessary information.

The postal and other similar markings such as postage stamp/stamping, mailing machine stamp and mail category indication such as mass mail, group mail, etc. will be preprinted on the detachable flap, whereby the envelope after the detachment of the flap remains clear of any unnecessary markings. Accordingly, after the flap is torn off, the envelope is free from any extra markings thus making it most suitable for reuse as a reply envelope.

The envelope according to the invention may have either one window for the receiver information, or alternatively, two windows of which one is for receiver information and the other for sender information. The size and shape of window(s) and the detachable flap may obviously be varied according to sender's needs.

Other characterizing properties of the invention are disclosed in the annexed claims.

BRIEF DESCRIPTION OF THE DRAWINGS

The invention is next described in greater detail with the help of a preferred whilst not limiting embodiment with reference to the appended drawings, in which:

FIG. 1 is a front view of an envelope according to the invention;

FIG. 2 is a front view of the envelope according to the invention with the detachable flap removed;

DETAILED DESCRIPTION OF THE INVENTION

With reference to FIGS. 1–5, the envelope 1 comprises a conventional letter envelope with a single window 2. The window 2, defining two adjacent areas 2' and 2" is provided to the front side of the envelope 1 and it has essentially parallel upper and lower edges as well as essentially parallel side edges. The front side of the envelope is additionally provided with a detachable flap 3 which also has essentially parallel upper and lower edges as well as essentially parallel side edges. The lower edge of the flap 3 forms the upper edge of the window 2 and the side edges of the flap 3 form extensions to the side edges of the window 2. The upper and the side edges of the flap 3 are adapted detachable from the front page of the envelope by means of, e.g., a perforation 4. Said flap 3 is thus easily detachable by tearing along said perforation 4. When the window 2 is desired to be extended upward, the preprinted reply receiver name and address information will stay in the same location on the envelope, whereby successful optical character recognition of the address information is facilitated.

Figure 3:
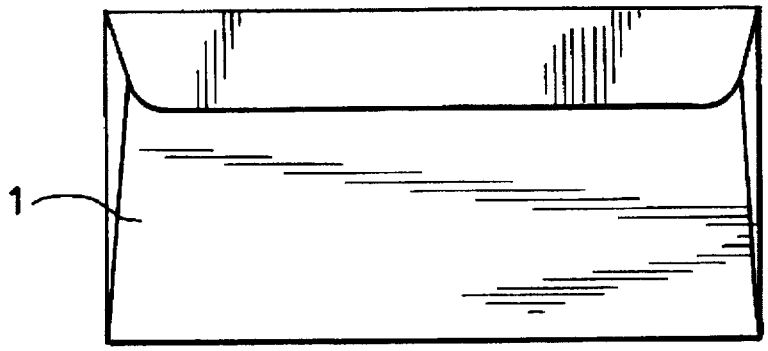
FIG. 3 is a rear view of the sealed envelope according to the invention.
Figure 4:
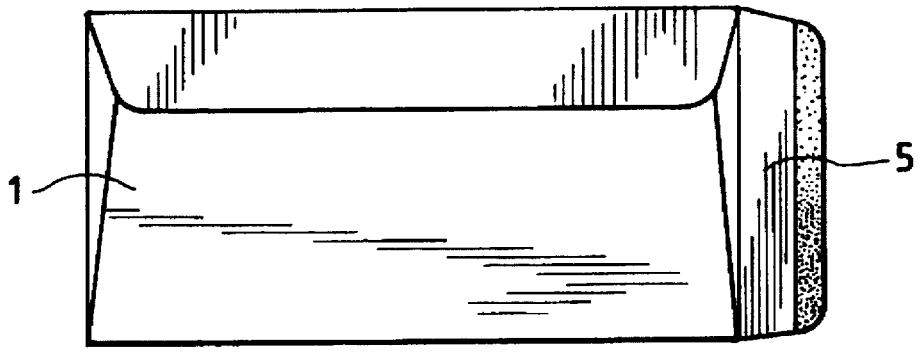
FIG. 4 is a rear view of the envelope according to the invention opened.
Figure 5:
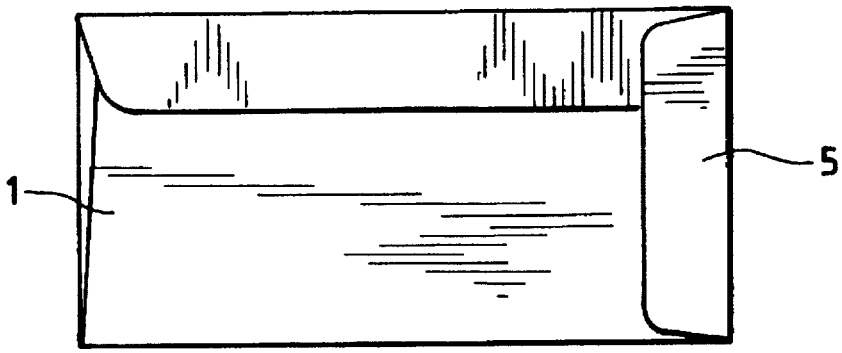
FIG. 5 is a rear view of the envelope according to the invention resealed.

As is evident from FIGS. 3–5, the envelope 1 can be opened by unfolding the sealing side flap 5 which during the mailing of the envelope is folded to the inside, after which the envelope can be resealed for reply mailing by folding and sealing the sealing flap 5 against the back side of the envelope. The sealing of the seal flap 5 may take place by means of, e.g., glue, self-adhesive seal strip or other conventional method suited to accomplish the required seal function. Different opening and sealing methods of an envelope are known in the art. Therefore, the invention is by no means limited to, e.g., an envelope adapted for opening at the side edge, but rather, the envelope can as well be adapted for opening at the upper or lower edge. However, the above-described type of side-flap-sealable envelope is advantageously suited for use in automatic mailing in which the insertion of letters into the envelopes takes place in an automated manner.

Furthermore, the invention is not limited to envelopes provided with a single window only, but rather, the envelope may contain several windows. The envelope may, e.g., have a second window placed to the left upper corner of the envelope, whereby said second window can be used for the display of sender information. The shape of the flap 3 may be different from the square shape shown in the diagrams.

Moreover, the other side edge of the flap 3 need not necessarily be continued directly from the corresponding side edge of the window 2, but rather from, e.g., center of the upper edge of the window, whereby the widened window will be essentially L-shaped.

I claim:

1. A mailing envelope (1) having a front wall and a rear wall, one of said walls being provided with at least one window (2), and a detachable flap (3), said envelope being intended for sequential use as both a sender's envelope and a reply envelope, wherein said window (2) contains two areas (2', 2"), a first of said areas being for displaying a recipient's name and address information appearing on an insert of said envelope and a second of said areas being for displaying postal markings, said detachable flap being contained in said second area prior to detachment of said flap from said envelope, said first area being sufficiently large to display the name and address information prior to detachment of said flap.

2. An envelope as defined in claim 1, wherein said flap (3) is adapted to cover the upper part of the window (2).

3. An envelope as defined in claim 1 wherein said flap (3) is made detachable by means of a perforation (4) from the material surrounding the window (2) of the envelope (1).

4. An envelope as defined in claim 2, wherein said detachable flap (3) is located at the upper right corner of the front wall of the envelope (1).

5. An envelope as defined in claim 2, wherein said flap (3) is made detachable by means of a perforation (4) from the material surrounding the window (2) of the envelope.

* * * * *